US010215539B2

(12) United States Patent
White et al.

(10) Patent No.: US 10,215,539 B2
(45) Date of Patent: Feb. 26, 2019

(54) BARRIER

(71) Applicant: Defenshield, Inc., St. Augustine, FL (US)

(72) Inventors: William Collins White, St. Augustine, FL (US); Jordan William Settle, Altoona, PA (US)

(73) Assignee: Defenshield, Inc., St. Augustine, FL (US)

( * ) Notice: Subject to any disclaimer, the term of this patent is extended or adjusted under 35 U.S.C. 154(b) by 0 days.

(21) Appl. No.: 15/042,632

(22) Filed: Feb. 12, 2016

(65) Prior Publication Data

US 2016/0238349 A1 Aug. 18, 2016

Related U.S. Application Data

(60) Provisional application No. 62/116,016, filed on Feb. 13, 2015.

(51) Int. Cl.

| | |
|---|---|
| ***F41H 5/24*** | (2006.01) |
| ***E04H 9/10*** | (2006.01) |
| ***F41H 11/08*** | (2006.01) |
| *F41H 5/013* | (2006.01) |
| *F41H 5/06* | (2006.01) |

(52) U.S. Cl.

CPC ..... *F41H 5/24* (2013.01); *E04H 9/10* (2013.01); *F41H 11/08* (2013.01); *F41H 5/013* (2013.01); *F41H 5/06* (2013.01)

(58) Field of Classification Search

CPC ... F41H 5/00; F41H 5/013; F41H 5/16; F41H 5/24; F41H 5/26; F41H 11/00

USPC ..... 89/36.01, 36.02, 36.04, 36.07, 901, 903, 89/918, 920, 936, 937

See application file for complete search history.

(56) References Cited

U.S. PATENT DOCUMENTS

| | | | | |
|---|---|---|---|---|
| 377,732 A | | 2/1888 | Adams | |
| 1,212,463 A | | 1/1917 | Doran | |
| 2,316,055 A | | 4/1943 | Davey | |
| 4,001,987 A | * | 1/1977 | Coulthard | E04B 2/7442 160/135 |
| 4,843,947 A | * | 7/1989 | Bauer | F41H 5/08 109/49.5 |
| 6,874,401 B2 | * | 4/2005 | Bishop | F42D 5/045 86/50 |

(Continued)

FOREIGN PATENT DOCUMENTS

DE 102012006056 B3 9/2013

OTHER PUBLICATIONS

Defenshield, Defenshield STEGO Modular Armor Video, May 13, 2013, YouTube, <https://www.youtube.com/watch?v=D1h5bljd_sg>, Entire Video, Available Apr. 30, 2017.*

(Continued)

*Primary Examiner* — Jonathan C Weber

(74) *Attorney, Agent, or Firm* — Baker & Hostetler LLP

(57) ABSTRACT

A barrier formed from one or more modular units that include a frame, a protective panel, and a gap that is configured to receive a portion of another one of the modular units of the barrier such that the one or more modular units of the barrier can be arranged at an angle selected from a range of angles from about 90 degrees, to provide a corner arrangement, to about 180 degrees, to provide a substantially straight wall arrangement.

20 Claims, 13 Drawing Sheets

(56) References Cited

U.S. PATENT DOCUMENTS 7,100,488 B2 * 9/2006 Bishop ..... F42D 5/045 86/50
7,117,644 B2 10/2006 Dehart
7,159,503 B1 * 1/2007 Weatherwax ..... F41H 5/06 86/50
7,325,475 B2 * 2/2008 Long ..... B60P 1/6445 296/181.7
7,520,207 B1 * 4/2009 Fuqua ..... F41H 5/013 109/82
7,806,038 B2 * 10/2010 Duke ..... E04B 2/06 89/36.01
7,934,444 B2 * 5/2011 Carberry ..... E04H 9/10 109/49.5
8,015,910 B1 9/2011 Fuqua et al.
8,069,769 B2 * 12/2011 Carberry ..... E04H 9/10 109/49.5
8,234,967 B2 * 8/2012 Carberry ..... E04H 9/10 109/49.5
D672,474 S * 12/2012 White ..... D25/58
8,397,618 B2 * 3/2013 White ..... F41H 5/24 52/741.3
8,656,821 B2 * 2/2014 White ..... F41H 5/24 52/741.3
8,726,780 B2 * 5/2014 White ..... F41H 5/08 89/36.04
9,212,871 B2 * 12/2015 White ..... F41H 5/24
9,222,759 B2 * 12/2015 White ..... F41H 5/08
9,448,041 B2 * 9/2016 Gonda ..... F41H 5/14
2005/0229771 A1 * 10/2005 Lewis ..... F41H 5/0492 89/36.02
2005/0235819 A1 * 10/2005 Long ..... B60P 1/6445 89/36.07
2006/0254412 A1 * 11/2006 Long ..... B60P 1/6445 89/36.07
2007/0006542 A1 * 1/2007 Duke ..... E04B 2/06 52/561
2007/0012168 A1 * 1/2007 Weatherwax ..... F41H 5/06 89/36.04
2009/0067923 A1 * 3/2009 Whitford ..... F41H 11/08 404/6
2009/0100997 A1 * 4/2009 Fuqua ..... F41H 5/013 89/36.02
2010/0043629 A1 * 2/2010 Carberry ..... E04H 9/10 89/36.02
2010/0282060 A1 * 11/2010 Duke ..... E04B 2/08 89/36.02
2010/0290833 A1 * 11/2010 Whitford ..... F41H 11/08 404/6
2011/0000362 A1 * 1/2011 Carberry ..... E04H 9/10 89/36.02
2011/0209605 A1 * 9/2011 Carberry ..... E04H 9/10 89/36.02
2012/0160087 A1 * 6/2012 Sigurdson ..... E04B 1/04 89/36.02
2012/0168702 A1 * 7/2012 Fromm ..... E01F 13/12 256/13.1
2012/0174763 A1 * 7/2012 Ritchie ..... E04H 9/10 89/36.04
2012/0279383 A1 * 11/2012 Carberry ..... E04H 9/10 89/36.02
2012/0291619 A1 * 11/2012 White ..... F41H 5/24 89/36.02
2013/0340603 A1 * 12/2013 Johnson ..... F41H 5/24 89/36.02
2014/0216239 A1 * 8/2014 White ..... F41H 5/08 89/36.02
2015/0013922 A1 1/2015 Pegrum
2015/0308792 A1 * 10/2015 Tyler ..... F41H 5/013 89/36.02

OTHER PUBLICATIONS

European Patent Application No. 16749967.2; Extended Search Report; dated Aug. 24, 2018; 9 pages.

* cited by examiner

BARRIER

CROSS REFERENCE TO RELATED APPLICATIONS

This application claims the benefit of U.S. Provisional Application No. 62/116,016, filed Feb. 13, 2015, the disclosure of which is hereby incorporated by reference in its entirety herein.

TECHNICAL FIELD

The present disclosure relates generally to barriers, and more specifically to barriers comprising modular units of ballistic proof material.

BACKGROUND

In military and para-military operations, there is often a need for barriers behind which personnel can position themselves for protection from ballistics, explosives, or other harmful projectiles. Historically, soldiers have dug fox holes or trenches, or utilized natural bunkers as protection against enemy fire. In certain geographic regions, natural barrier formations may not exist, and it may not be practicable or suitable to utilize trenches or fox holes for adequate protection.

SUMMARY

Applicants disclose a barrier composed of modular units that structurally interface with each other to form a cohesive unit. In an example embodiment, a modular unit comprises a frame and a protective panel coupled to the frame. The protective panel has a first side that faces the frame and a second side that is opposite the first side and which includes a ballistic resistant material configured to withstand a ballistic projectile fired toward the barrier. The modular unit further comprises a member coupled to at least one of the frame and the protective panel such that the member extends away from the first side of the protective panel, thereby defining a gap between the first side of the protective panel and a first surface of the member. The gap defines an angle measured from the first side of the protective panel to the first surface of the member. The gap is configured to receive at least a portion of a protective panel of another modular unit of the ballistic barrier.

In an example embodiment, a ballistic barrier may be formed from at least a first modular unit and a second modular unit. The first modular unit may comprise a first frame and a first protective panel coupled to the first frame. The first protective panel has a first side that faces the first frame and a second side that is opposite the first side and which includes a ballistic resistant material configured to withstand a ballistic projectile fired toward the barrier. The first modular unit further has a member coupled to at least one of the first frame and the first protective panel such that the member extends away from the first side of the first protective panel and defines a gap between the first side of the first protective panel and a first surface of the member. The second modular unit has a second frame and a second protective panel coupled to the second frame. The second protective panel has a first side that faces the second frame and a second side that is opposite the first side of the second protective panel. The second side of the second protective panel includes a ballistic resistant material configured to withstand a ballistic projectile fired toward the barrier. In an example embodiment, the ballistic barrier defines an assembled configuration in which a portion of the second protective panel is positioned within the gap such that the ballistic barrier defines a straight line passes through each of: 1) the first surface of the member, 2) the gap, 3) the portion of the second protective panel, and the first side of the first protective panel.

According to an aspect of the disclosed embodiments, the modular units may be arranged and interconnected in various different configurations. In an example embodiment, the ballistic barrier defines an assembled configuration in which: 1) the second protective panel abuts the first protective panel thereby defining a first point of contact between the first and second modular units, and 2) the second protective panel abuts the first surface of the member thereby defining a second point of contact between the first and second modular units, the ballistic barrier defining the first and second points of contact simultaneously.

The present application further discloses methods of assembling a ballistic barrier. In an example scenario, a first modular unit is positioned on a surface such that a first side of a first protective panel of the first modular unit faces in a first direction and a second side of the first protective panel faces in a second direction that is opposite the first direction. The second side includes a planar portion that defines a first plane. The method further includes the step of selecting an angle, from a range of angles, at which to position a second modular unit of the ballistic barrier with respect to the first modular unit. The angle may be measured between a first line that lies entirely within the first plane and a second side of a second protective panel of the second modular unit. The second modular unit is positioned on the surface adjacent to the first modular unit such that a portion of the second protective panel is disposed within a gap that is at least partially defined by: 1) a first surface of a member of the first modular unit that extends away from the first side of the first protective panel, and 2) the first side of the first protective panel. The gap is configured such that the second positioning step can be performed at any angle within the range of angles.

BRIEF DESCRIPTION OF THE DRAWINGS

The foregoing summary, as well as the following detailed description of illustrative embodiments of the barrier of the present application, will be better understood when read in conjunction with the appended drawings. For the purposes of illustrating the barrier of the present application, there is shown in the drawings illustrative embodiments. It should be understood, however, that the application is not limited to the precise arrangements and instrumentalities shown. In the drawings.

DETAILED DESCRIPTION OF ILLUSTRATIVE EMBODIMENTS

Figure 1A:
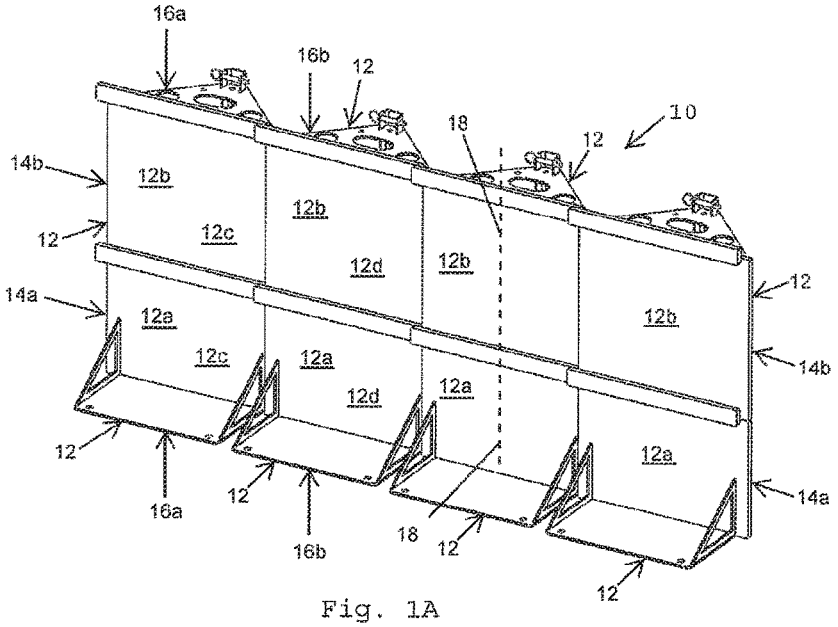
FIG. 1A is a front perspective view of a barrier according to one embodiment, the barrier including a plurality of components.
Figure 1B:
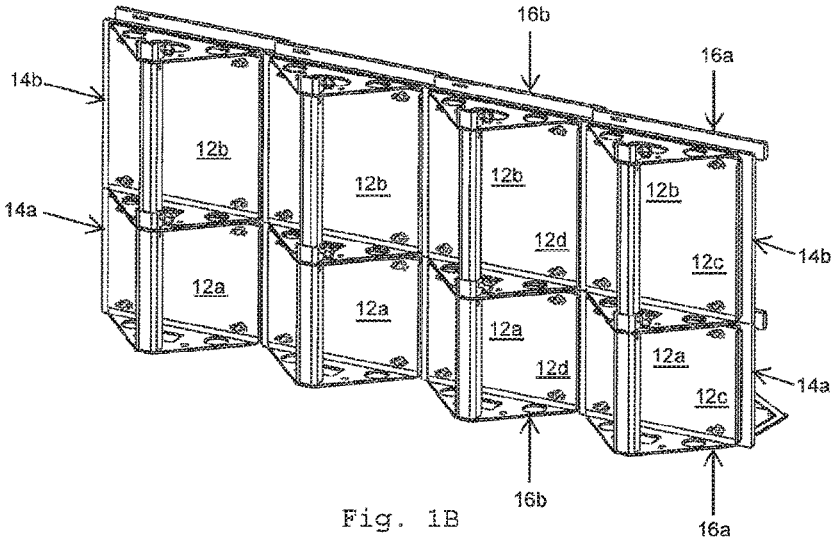
FIG. 1B is a rear perspective view of the barrier illustrated in FIG. 1A.
Figure 2A:
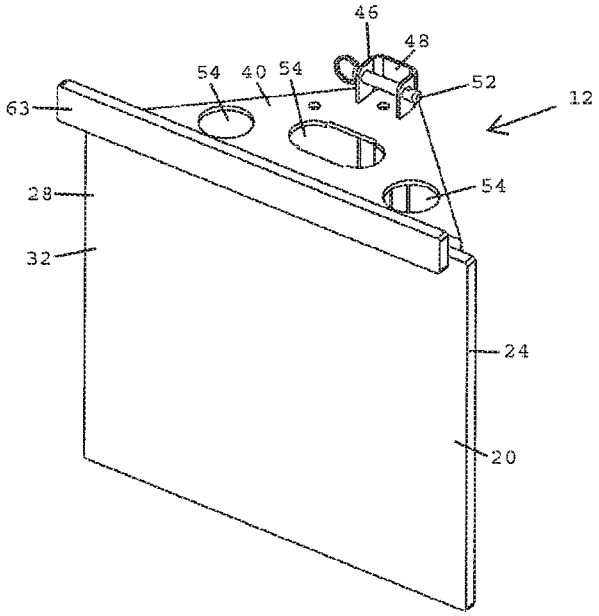
FIG. 2A is a front perspective view of a component of the barrier illustrated in FIG. 1A.
Figure 2B:
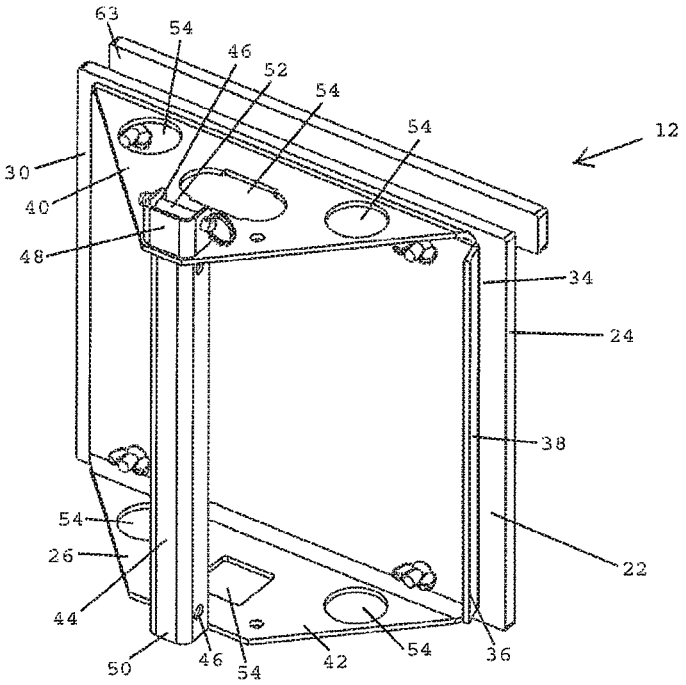
FIG. 2B is a rear perspective view of the component illustrated in FIG. 2A.
Figure 2C:
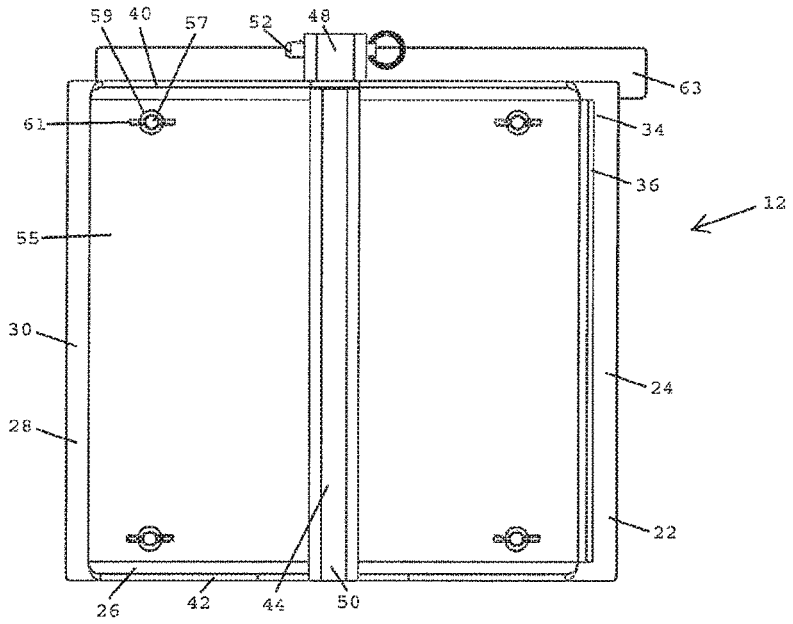
FIG. 2C is a rear elevation view of the component illustrated in FIG. 2A.
Figure 2D:
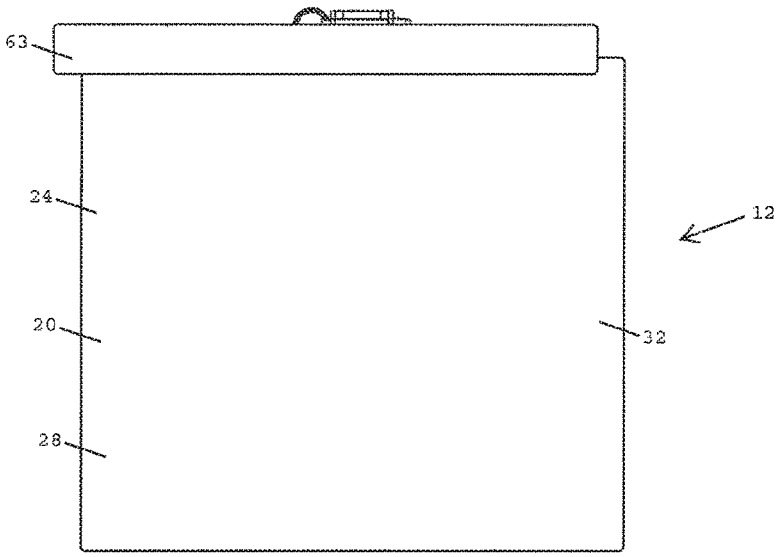
FIG. 2D is a front elevation view of the component illustrated in FIG. 2A.
Figure 2E:
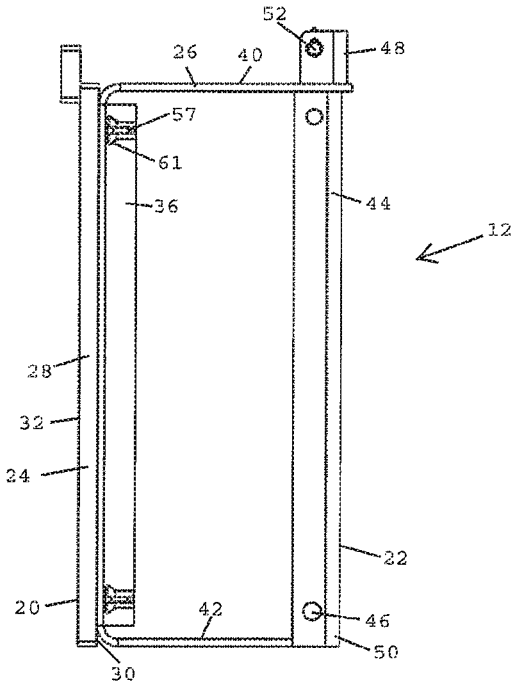
FIG. 2E is a right side elevation view of the component illustrated in FIG. 2A.
Figure 2F:
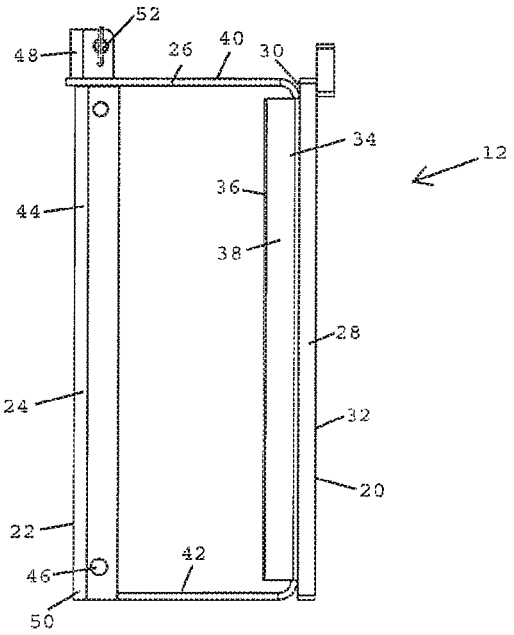
FIG. 2F is a left side elevation view of the component illustrated in FIG. 2A.
Figure 2G:
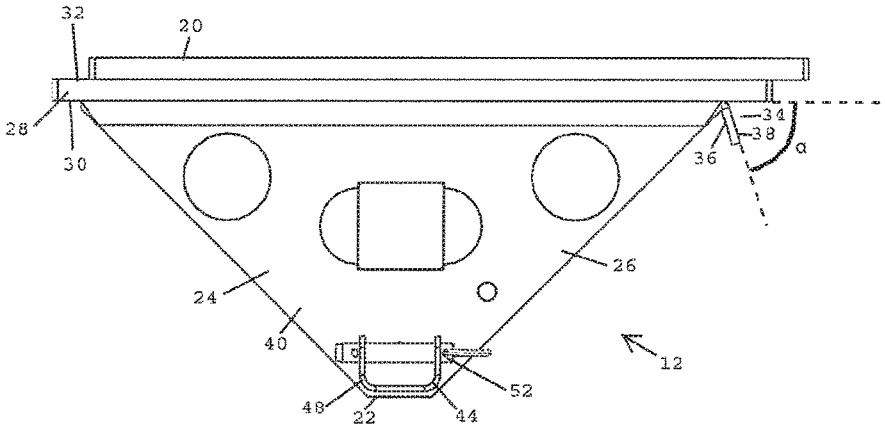
FIG. 2G is a top plan view of the component illustrated in FIG. 2A.
Figure 2H:
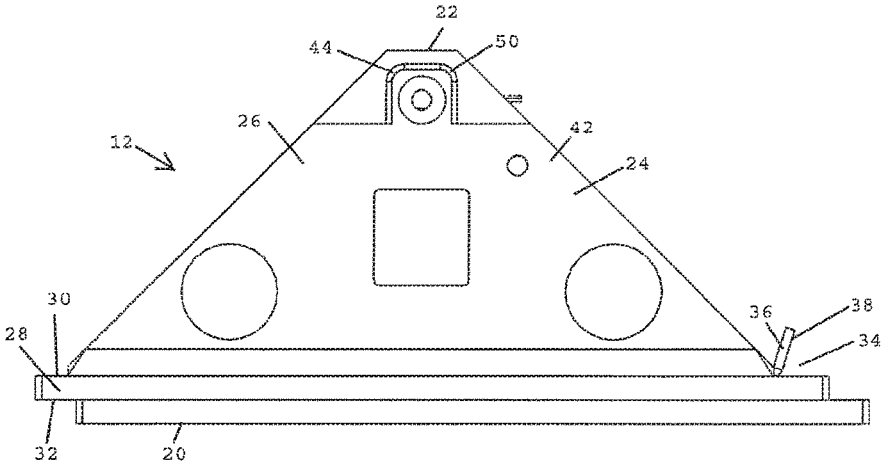
FIG. 2H is a bottom plan view of the component illustrated in FIG. 2A.
Figure 3A:
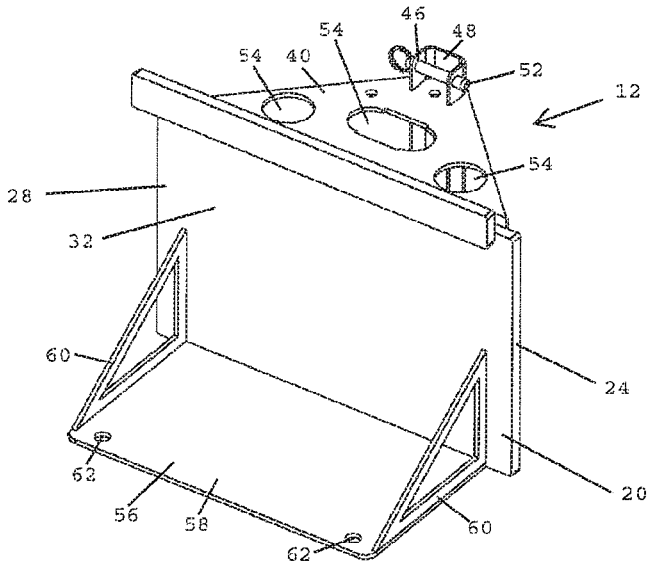
FIG. 3A is a front perspective view of another component of the barrier illustrated in FIG. 1A.
Figure 3B:
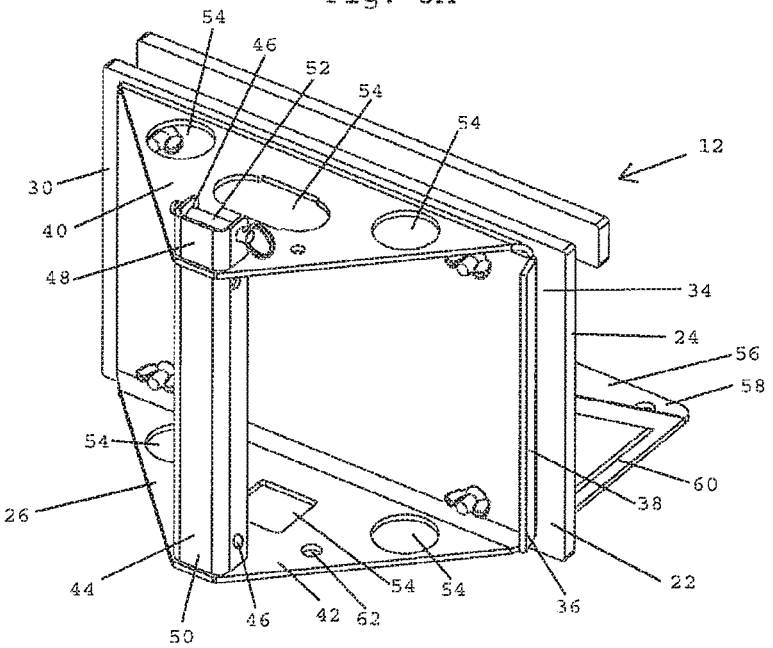
FIG. 3B is a rear perspective view of the component illustrated in FIG. 3A.
Figure 3C:
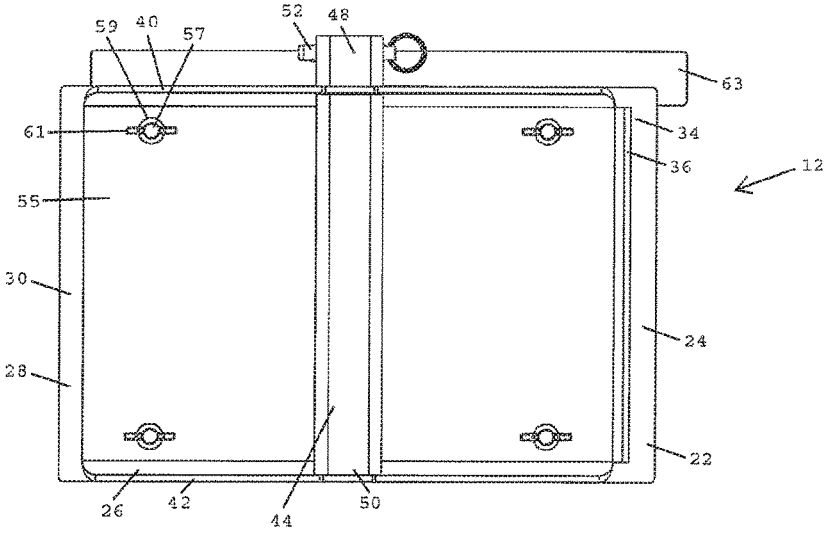
FIG. 3C is a rear elevation view of the component illustrated in FIG. 3A.
Figure 3D:
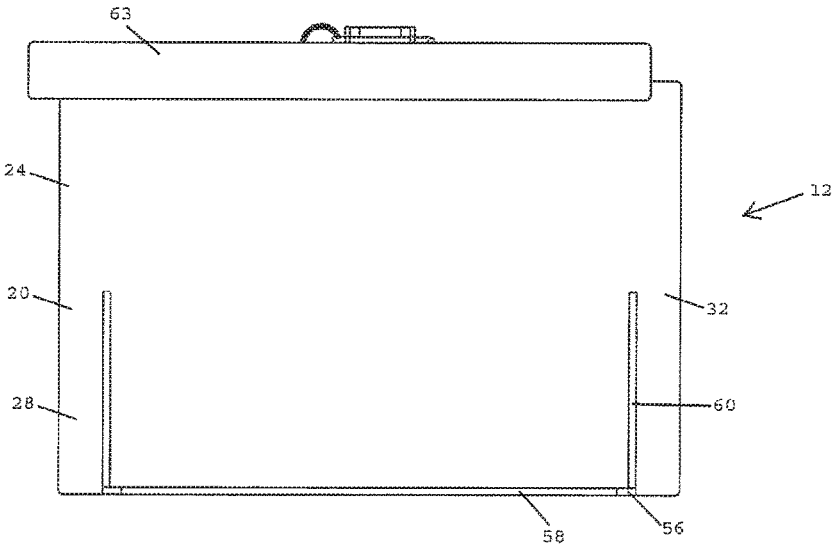
FIG. 3D is a front elevation view of the component illustrated in FIG. 3A.
Figure 3E:
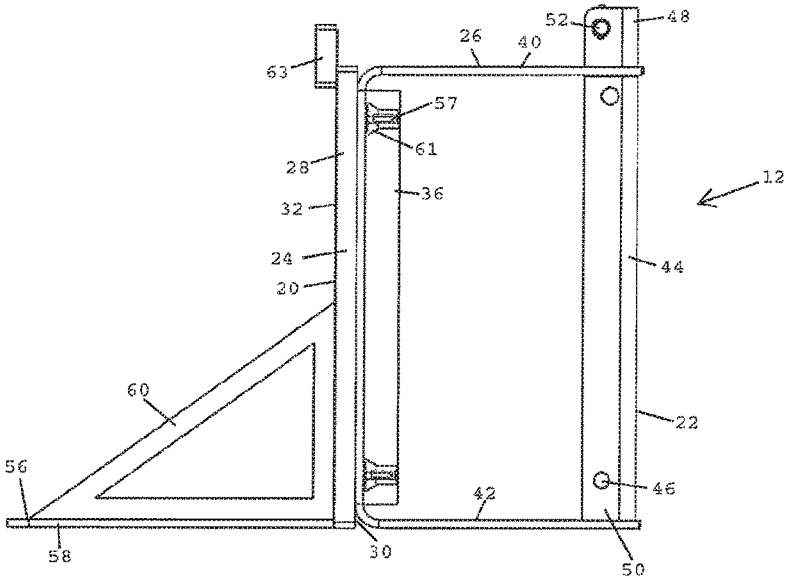
FIG. 3E is a right side elevation view of the component illustrated in FIG. 3A.
Figure 3F:
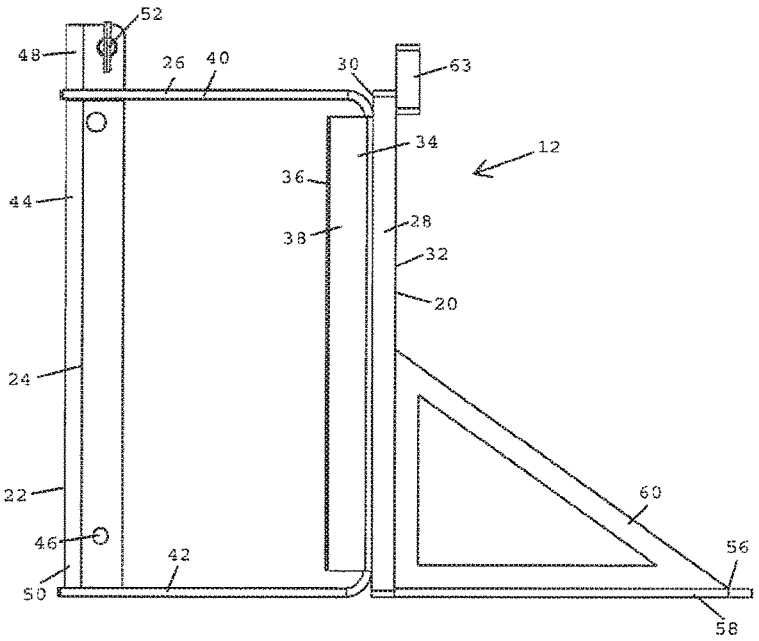
FIG. 3F is a left side elevation view of the component illustrated in FIG. 3A.
Figure 3G:
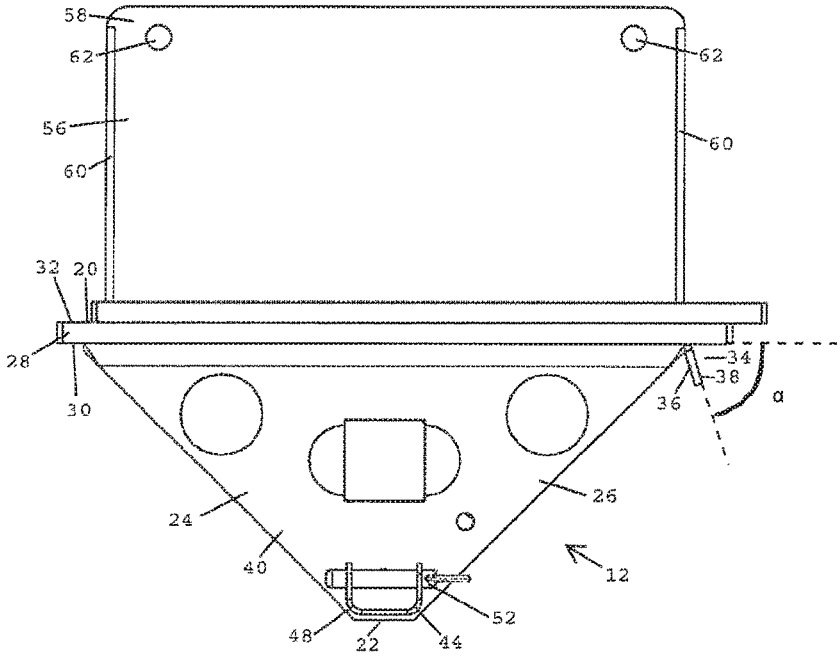
FIG. 3G is a top plan view of the component illustrated in FIG. 3A.
Figure 3H:
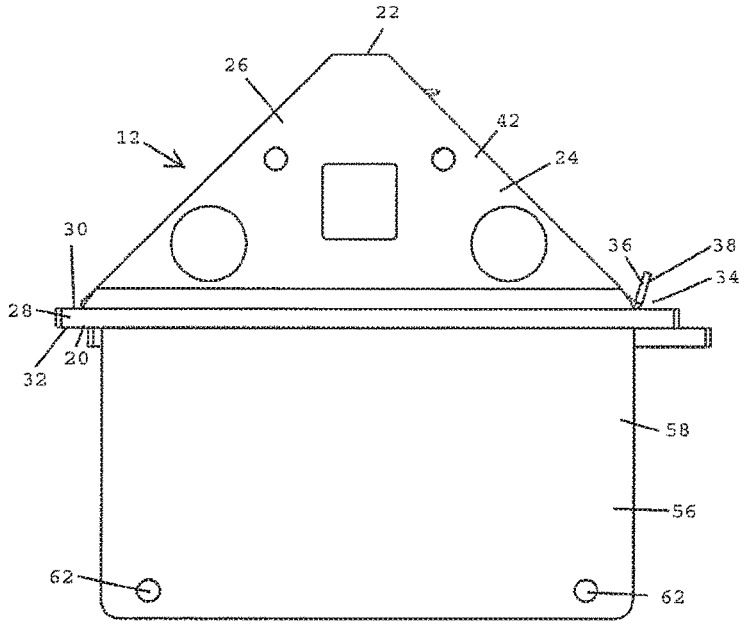
FIG. 3H is a bottom plan view of the component illustrated in FIG. 3A.

FIGS. 1A and 1B provide front and rear perspective views, respectively, of an example barrier 10 formed from modular units 12. As shown, a barrier 10 includes at least one modular unit 12 positioned adjacent to and interconnected with another modular unit. The barrier 10 can include a row 14 of modular units 12 positioned adjacent one another such that each of the modular units 12 of the row 14 is at substantially the same height off the ground or other supporting surface with respect to each other. Variations in height of the modular units 12 in the row 14 may arise as consequence of the barrier 10 being constructed on uneven ground or other supporting surface. As shown in the illustrated embodiments, the barrier 10 can include a plurality of rows 14 including a first row 14*a* having a plurality of modular units 12*a* positioned adjacent one another, and a second row 14*b* having a plurality of modular units 12*b* positioned adjacent one another.

The barrier 10 can include a column 16 of modular units 12 positioned on top of, or vertically with respect to, one another. As shown in the illustrated embodiments, the barrier 10 can include a plurality of columns 16 including a first column 16*a* having a plurality of modular units 12*c* positioned on top of one another, and a second column 16*b* having a plurality of modular units 12*d* positioned on top of one another. As shown, each of the modular units 12 of the column 16 can be stacked such that the centerlines 18 of each of the modular units 12 of the respective column 16 are aligned. Alternatively, each of the modular units 12 of the column 16 can be stacked such that the centerlines 18 of each of the modular units 12 of the respective column 16 are not aligned. According to one embodiment, each of the modular units 12 is part of one row 14 and one column 16.

In an example embodiment, each of the modular units 12 is configured to be human-portable according to military standards. For example, in one embodiment, each of the modular units 12 weighs less than 45 pounds. According to another embodiment, each of the modular units 12 weighs less than 30 pounds.

FIGS. 2A through 2H provide various views of an example modular unit 12. As shown, in an example embodiment, the modular unit 12 includes a first side 20 that faces in a first direction and a second side 22 that faces in a second direction, which may be, for example, the opposite the first direction. The first side 20, according to one embodiment, is configured to face toward a threat, such as, for example, a ballistic projectile when the modular unit 12 is arranged as part of the barrier 10. The second side 22 is configured to face away from a threat and may face, for example, a human that seeks safety behind the barrier 10. The modular unit 12 includes or may be composed of a ballistic resistant material such as, for example, a material configured to withstand rifle rounds rated up to NIJ level IV 30-06 AP. In an example embodiment, at least a portion of, and up to an entirety of the first side 20 of the modular unit 12 may be composed of or comprise ballistic resistant material.

The modular unit 12 includes a body 24 that comprises a frame 26 and a protective panel 28. The protective panel 28 is configured to be connected to the frame 26 either releasably, such as with fasteners, or integrally, such that the frame 26 and protective panel 28 are monolithic with one another. The protective panel 28 has a first side 30 that faces the frame 26 when the protective panel 28 is coupled to the frame 26. The protective panel 28 further has a second side 32 that is opposite the first side 30, such that the second side 32 faces away from the frame 26 when the protective panel 28 is coupled to the frame 26. As shown in the illustrated embodiment, the modular unit 12 can further include a gap 34 defined at least partially, for example entirely, by the body 24. The gap 34 is configured to receive a portion of another modular unit 12 of the barrier 10.

The modular unit 12 includes a member 36 carried by the body 24. In an example embodiment, the member 36 is coupled to at least one of the frame 26 and the protective panel 28. The member 36 extends out from the first side 30 of the protective panel 28 at an angle. The member 36 has a first surface 38 that, along with the first side 30 of the protective panel 28, defines at least a portion of the gap 34. The gap 34 defines an angle $\alpha$ measured, in an illustrated embodiment, from the first surface 38 of the member 36 to the first side 30 of the protective panel 28. According to one embodiment, the modular unit 12 defines an angle $\alpha$ between about 0° and about 90°. According to another embodiment, the modular unit 12 defines an angle $\alpha$ between about 30° and about 60°. The modular unit 12 defines an angle $\alpha$ having a value such that the gap is configured to receive at least a portion of a protective panel 28 of another modular unit 12 of the ballistic barrier 10.

The second side 32 of the protective panel 28 includes at least a portion that is substantially planar such that at least the portion of the second side 32 defines a plane.

The frame 26 can include a top plate 40 and a bottom plate 42 that each share a common edge with and extend in a direction from the first side 30 of the protective panel 28. As shown, the top and bottom plates 40, 42 each extend from the first side 30 in respective planes that are perpendicular to the plane defined by the portion of the second side 32. The frame 26 can further include a tubular member 44 that extends between and interconnects the top plate 40 and the bottom plate 42, for example at their respective, outwardly positioned vertices.

The tubular member 44 may be substantially square in cross-section and include a plurality of holes 46 formed through respective surfaces of the tubular member 44. Respective ones of the holes 46 can be on opposing sides of the tubular member 44 such that ones of the holes 46 are diametrically aligned with one another. In addition, the tubular nature of tubular member 44 can extend fully through the top plate 40 and the bottom plate 42, providing a tubular passage therethrough. It should be appreciated that the tubular member 44 may have any suitable configuration and need not be square tubular, or even fully tubular. Rather, the tubular member 44 need merely allow for interconnection to a vertically adjacent tubular member 44 of another modular unit 12.

An upper portion 48 of the tubular member 44 and a lower portion 50 of the tubular member 44 are dimensioned such that one will fit inside the other, with the holes 46 in the upper portion of one modular unit 12 aligning with the holes 46 of the lower portion 50 of another modular unit 12 positioned thereon. The first and second ones of the modular units 12 may be interconnected to each other and held together via any conventional fastener 52, such as a bolt or pin, inserted through the aligned holes 46 of the stacked modular units 12. The tubular member 44 may also be formed from separate upper and lower sections that are configured to vertically interconnect adjacent ones of the modular units 12.

The top plate 40 and the bottom plate 42 can each include one or more openings 54 that extend through the respective one of the top plate 40 or the bottom plate 42. In an example embodiment, the one or more openings 54 include an opening 54 positioned centrally within the respective one of the top plate 40 or the bottom plate 42. The one or more openings 54 may also include an opening 54 positioned adjacent an edge of the respective one of the top plate 40 or the bottom plate 42. The one or more openings 54 can include openings 54 with different sizes, different shapes, or different sizes and shapes. The one or more openings 54 can be configured to receive a linkage member that operates to secure two or more modules relative to each other. In an example embodiment, the linkage member may be, for example, a flexible member such as a bungee cord or an inflexible member such as a crossbar, that is passed through or connected to at least one of the one or more openings 54 of both a first modular unit 12 and a second modular unit 12 to secure the first and second modular units 12 relative to one another.

The linkages member can be configured to be attached to first and second ones of the modular units 12 so as to permit pivotal movement of the first modular unit 12 relative to the second modular unit 12 and vice versa. The pivotal positioning of the modular units 12 permits the barrier 10 that is formed from the modular units to be formed in any desired shape, including a planar wall structure, a curved barrier structure, or even a fully enclosed barrier (where all personnel would be fully enclosed on all sides by the barrier).

According to one embodiment, the body 24 of the modular unit 12 includes a mounting panel 55 to which the protective panel 28 may be attached. For example, the protective panel 28 can include one or more threaded posts 57 that are configured to be inserted through corresponding holes 59 defined by the protective panel 28. Once the threaded posts 57 are inserted through the corresponding holes 59, a plurality of fasteners 61 such as, for example, wing nuts, can then be threaded onto the threaded posts 57 to mount the protective panel 28 onto the mounting panel 55. Where the protective panel 28 is removably attached to the mounting panel, the protective panel 28 can be replaced in the event of damage without having to dissemble the barrier 10. Any suitable form of securing the protective panel 28 to the mounting panel 55 may alternatively be used including, for example, rivets, bolts, clips, and the like.

According to one embodiment, the body 24 of the modular unit 12 can include at least one armor strip 63. As shown, the body 24 can include an armor strip 63 positioned on the second side 32 of the protective panel 28 such that the armor strip 63 is configured to cover a seam, or a space between, adjacent ones of the modular units 12 when the adjacent ones of the modular units 12 are positioned adjacent to one another. For example, the armor strip 63 may cover a seam or space between modular units 12 when the units are arranged horizontally to create a row 14 or vertically to create a column 16.

FIGS. 3A to 3H provide various views of an example modular unit comprising a support assembly. Referring to FIGS. 3A to 3H, a barrier 10 may include an embodiment of the modular unit 12 that is configured to be a base, or a bottom, of one of the columns 16 of the barrier 10. The body 24 of the modular unit 12 can include a foot assembly 56 that is configured to provide stable support for the modular unit 12 so that the modular unit 12 does not tip over as a result of a force such as, for example, a force from a ballistic projectile impacting the modular unit 12. According to one embodiment, the foot assembly 56 includes a base plate 58 coupled to the protective panel 28 such that the base plate 58 extends out from the second side 32 of the protective panel 28. The foot assembly 56 can further include one or more coupling members 60 configured to couple the base plate 58 to the body 24. As shown, the one or more coupling members 60 can be in the form of triangular braces that abut both the base plate 58 and the second side 32 of the protective panel 28. The coupling members 60 may be attached to base plate 50 and sides 32 by any suitable means including, for example, by welding.

According to one embodiment, the foot assembly 56 is configured to cooperate with the bottom plate 42 of the frame 26 to define a substantially planar surface that faces the ground, or other surface the barrier is being assembled upon, and supports the modular unit 12 such that tipping of the modular unit 12 is prevented. The bottom plate 42, the base plate 58, or both the bottom plate 42 and the base plate 58 can include one or more anchor holes 62 each configured to receive an anchor member that can be driven through a respective one of the one or more anchor holes 62 and into the ground or supporting surface, thereby providing additional anchoring of the modular unit 12 such that the modular unit 12 will not tip over as a result of a force applied to the modular unit 12.

Figure 4:
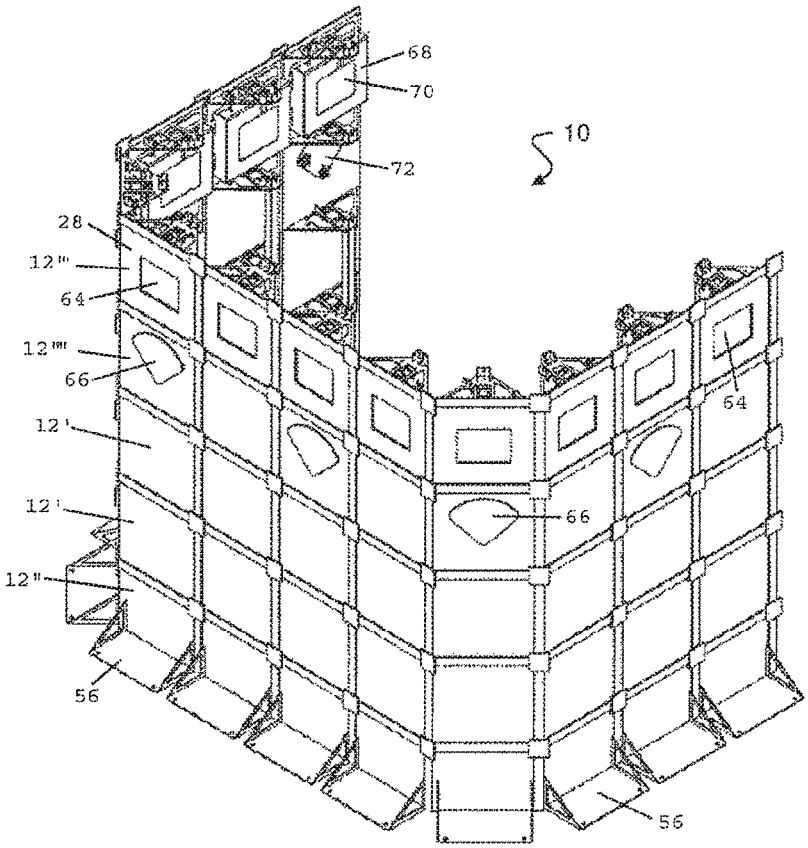
FIG. 4 is a front perspective view of a barrier according to another embodiment.

FIG. 4 provides a perspective view of a barrier 10 composed of modular units 12, some of which comprise additional structural elements. Referring to FIG. 4, one or more of the modular units 12 of the barrier 10 can have additional structures that can provide additional functionality as described in detail below. For example, the barrier 10 can include one or more of a first modular unit 12' that includes a protective panel 28 which may be, for example, a solid panel of ballistic resistant material such as described above in connection with FIGS. 2A to 2H. The barrier 10 can further include one or more of a second modular unit 12" that includes the foot assembly 56 such as described above in connection with FIGS. 3A to 3H. The barrier 10 can further include one or more of a third modular unit 12''' that includes a view port 64 that provides visibility through the barrier 10. The barrier can still further include one or more of a fourth modular unit 12'''' that includes a gun port 66 that provides an aperture through which a gun can be fired through the barrier 10. It should be recognized by those of skill in the art that one or more of the modular units 12 of the barrier 10 may be provided with any number of features that are desirable or advantageous in a ballistic barrier.

According to one embodiment, the view port 64 of the third modular unit 12''' can include a pivotal window frame 68 that carries a transparent portion 70, the transparent portion 70 composed of ballistic resistant material. As shown the view port 64 can be positioned within the protective panel 28. According to one embodiment the fourth modular unit 12'''' can include a movable cover 72 composed of a ballistic resistant material. The movable cover 72 is configured to be movably coupled, for example rotatably coupled, slidably coupled, or rotatably and slidably coupled, to the fourth modular unit 12'''' such that the movable cover 72 can be moved to selectively expose or cover an aperture of the gun port 66 through which a weapon, for example a gun, can be pointed and discharged.

Figure 5:
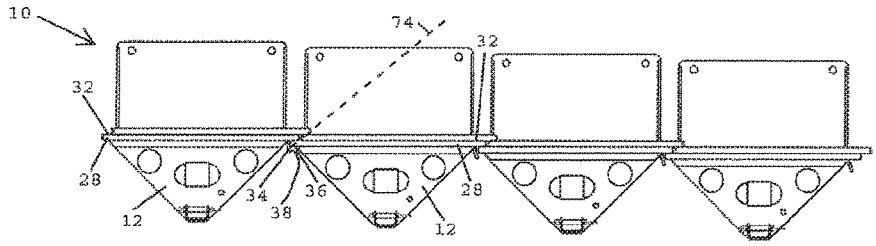
FIG. 5 is a top plan view of a barrier according to another embodiment.

As illustrated in FIGS. 4 to 7, the structural features of the modular units 12 allow for the barrier 10 to be assembled in various configurations. Referring to FIG. 5, in one embodiment, the barrier 10 can be assembled in a substantially straight line, such that the second side 32 of the protective panel 28 of a first one of the modular units 12 is substantially parallel to the second side 32 of the protective panel 28 of a second one of the modular units 12 that is positioned adjacent to the first one of the modular units 12. As shown in the illustrated embodiment, the barrier 10 can be assembled such that a portion of the second one of the modular units 12, for example a portion of the protective panel 28 of the second one of the modular units 12, is positioned within the gap 34 of the first one of the modular units 12.

According to one embodiment, the portion of the protective panel 28 of the second one of the modular units 12 is positioned within the gap 34 such that the portion of the protective panel 28 of the second one of the modular units 12 abuts one or both of the first side 30 of the protective panel 28 of the first one of the modular units 12 and the member 36 of the first one of the modular units 12. The portion of the protective panel 28 of the second one of the modular units 12 may be positioned within the gap 34 such that a straight line 74 that is normal to the first surface 38 of the member 36 intersects the portion of the protective panel 28 of the second one of the modular units 12.

Figure 6:
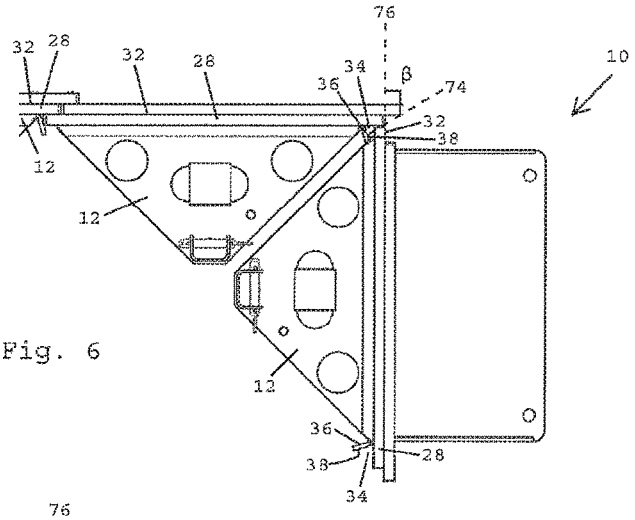
FIG. 6 is a top plan view of a barrier according to another embodiment.
Figure 7:
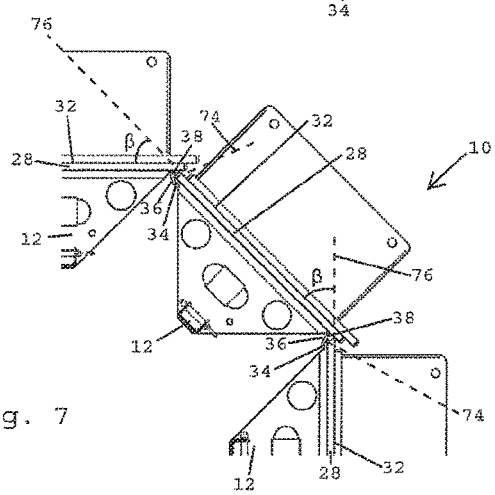
FIG. 7 is a top plan view of a barrier according to another embodiment.
Figure 8A:
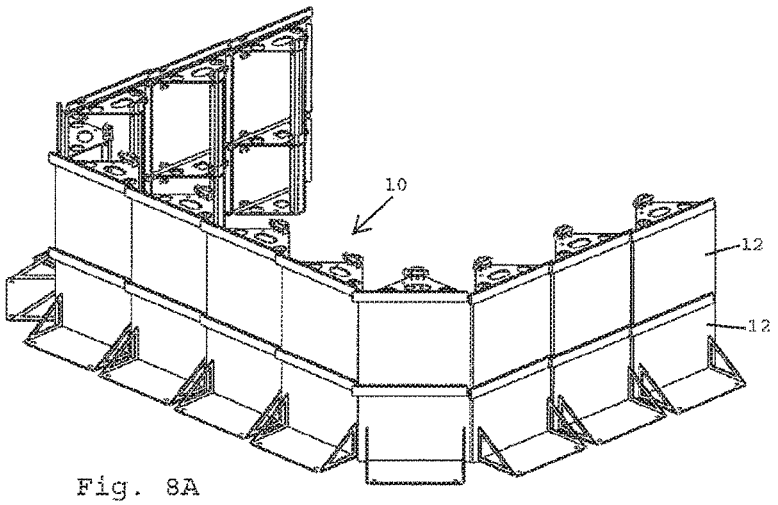
FIG. 8A is a front perspective view of a barrier according to another embodiment.
Figure 8B:
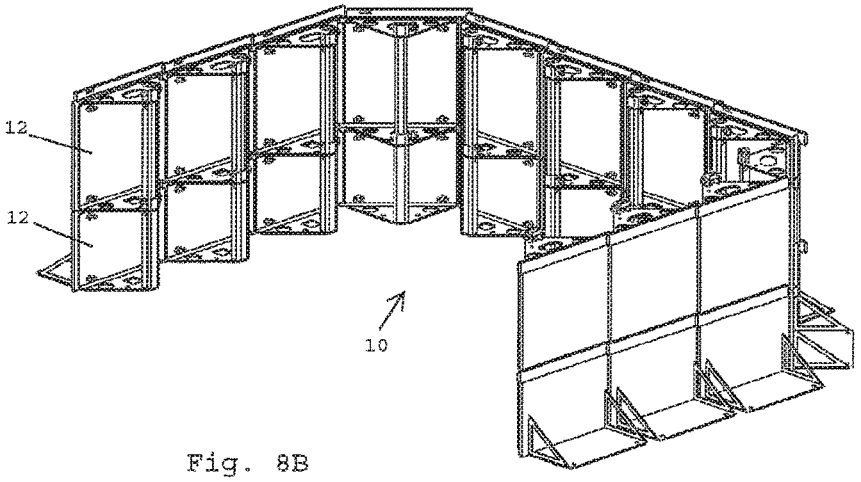
FIG. 8B is a rear perspective view of the barrier illustrated in FIG. 7A.
Figure 9A:
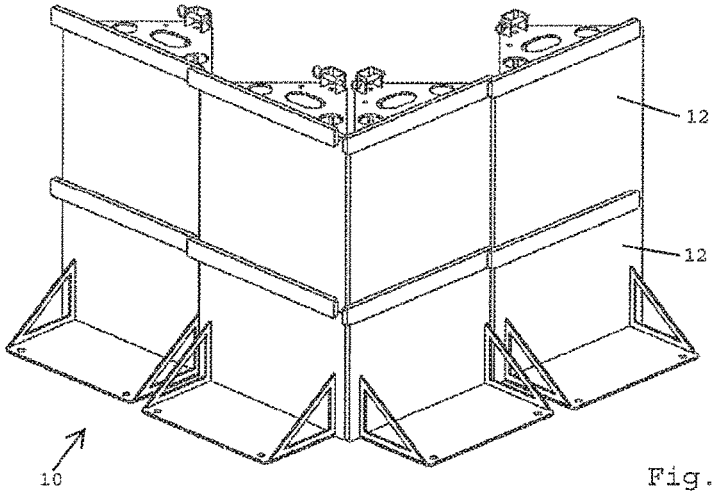
FIG. 9A is a front perspective view of a barrier according to another embodiment.
Figure 9B:
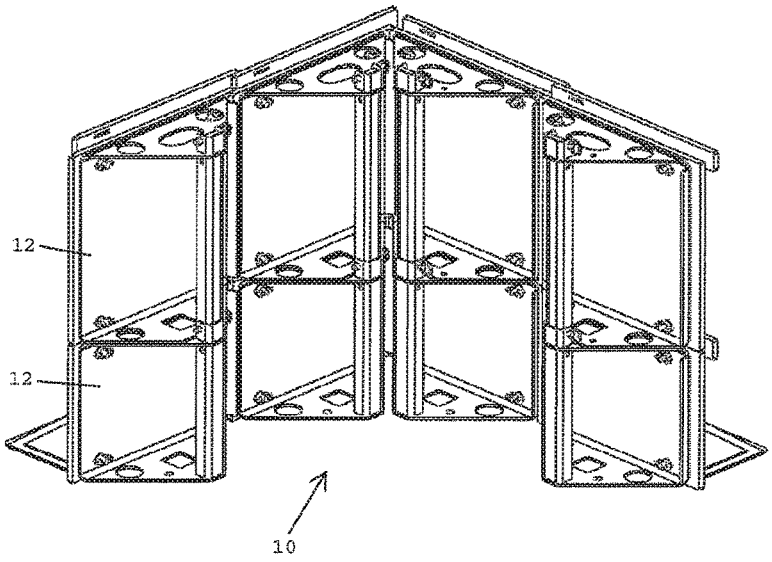
FIG. 9B is a rear perspective view of the barrier illustrated in FIG. 8A.

As illustrated in FIGS. 4, 6, and 7, the barrier 10 can be assembled in a shape other than a straight line. The barrier 10 may include a first one of the modular units 12 positioned adjacent a second one of the modular unit 12 such that the second side 32 of the protective panel 28 of the first one of the modular units 12 is offset with respect to the second side 32 of the protective panel 28 of the second one of the modular units 12 by an angle β. According to one embodiment, the barrier 10 can be assembled such that the angle β is within the range from between about 0° to about 90°. For example, the angle β may be about 45°. According to another embodiment, the barrier 10 can be assembled such that the angle β is greater than or equal to about 90°. In one embodiment, the barrier 10 can include a first pair of adjacent ones of the modular units 12 offset by a first angle β, and a second pair of adjacent ones of the modular units offset by a second angle β that is different than the first angle β. As shown in the illustrated embodiment, the barrier 10 can be assembled such that a portion of the second one of the modular units 12, for example a portion of the protective panel 28 of the second one of the modular units 12, is positioned within the gap 34 of the first one of the modular units 12.

According to one embodiment, the portion of the protective panel 28 of the second one of the modular units 12 is positioned within the gap 34 such that the portion of the protective panel 28 of the second one of the modular units 12 abuts at least one of (i.e., one or both) of the first side 30 of the protective panel 28 of the first one of the modular units 12 and the member 36 of the first one of the modular units 12. According to another embodiment, the portion of the protective panel 28 of the second one of the modular units 12 is positioned within the gap 34 such that a straight line 74 that is normal to the first surface 38 of the member 36 intersects the portion of the protective panel 28 of the second one of the modular units 12.

Modular units 12 may be assembled to form a barrier 10 that has any suitable configuration. For example, in one embodiment, the barrier 10 can be assembled such that the barrier includes both: 1) a first one of the modular units 12 positioned adjacent a second one of the modular units 12 such that the second side 32 of the protective panel 28 of the first one of the modular units 12 is offset with respect to the second side 32 of the protective panel 28 of the second one of the modular units 12 by an angle β, and 2) a third one of the modular units 12 positioned adjacent the first one of the modular units 12 such that the second side 32 of the protective panel 28 of the third one of the modular units 12 is substantially parallel to the second side 32 of the protective panel 28 of the first one of the modular units 12. In another embodiment, the barrier 10 can be assembled such that an outer perimeter of the barrier 10 defines a completely enclosed space, for example a substantially square shaped space.

FIGS. 8A and 8B and FIGS. 9A and 9B illustrate aspects of additional example barriers 10. Although the barrier 10 is shown having a height of two of the modular units 12, it will appreciated by those of skill in the art that the barrier 10 can be assembled to have a height as desired, for example a height of four or more of the modular units 12.

Referring to FIGS. 1A to 9B, a method of assembling the barrier 10 can include the step of positioning a first modular unit 12 on a surface, for example the ground, such that the first side 30 of the protective panel 28 of the first modular unit 12 faces in a first direction and a second side 32 of the protective panel 28 of the first modular unit 12 faces in a second direction that is opposite the first direction. According to one embodiment, the second side 32 can include a planar portion that defines a first plane. The method of assembling the barrier 10 can further include the step of selecting an angle β, from a range of angles, at which to position a second modular unit 12 of the barrier 10 with respect to the first modular unit 12, wherein the angle β is measured between a first straight line 76 that lies entirely within the first plane and the second side 32 of the protective panel 28 of the second modular unit 12. The method of assembling the barrier 10 can further include after performing the selecting step, the step of positioning the second modular unit 12 on the surface adjacent to the first modular unit 12 such that a portion of the protective panel 28 of the second modular unit 12 is disposed within the gap 34, the gap 34 at least partially defined by: 1) the first surface 38 of the member 36 of the first modular unit 12, the member 36 extending away from the first side 30 of the protective panel 28 of the first modular unit 12, and 2) the first side 30 of the protective panel 28 of the first modular unit 12. The method of assembling the barrier 10 can further include the gap 34 being configured such that the second positioning step can be performed at any angle β within the range of angles.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

Certain terminology is used in the following description for convenience only and is not limiting. The term "plurality", as used herein, means more than one. When a range of values is expressed, another embodiment includes from the one particular value and/or to the other particular value. Similarly, when values are expressed as approximations, by use of the antecedent "about," it will be understood that the particular value forms another embodiment. Further, reference to values stated in ranges includes each and every value within that range. All ranges are inclusive and combinable. Certain features of the invention which are described herein in the context of separate embodiments may also be provided in combination in a single embodiment. Conversely, various features of the invention that are described in the context of a single embodiment may also be provided separately or in any subcombination.

What is claimed:

1. A ballistic barrier, comprising:

a modular unit comprising:

a frame and a protective panel coupled to the frame, the protective panel having a first side that faces the frame and a second side that is opposite the first side with respect to a direction, the first side defining an outer perimeter, the first side further including a planar portion, and the second side including a ballistic resistant material configured to withstand a ballistic projectile fired toward the barrier; and a member coupled to at least one of the frame and the protective panel such that an entirety of the member is positioned within the outer perimeter with respect to the direction, the member extending directly from the first side of the protective panel at a first location on the planar portion such that a gap is defined between the planar portion of the first side of the protective panel and a first surface of the member, wherein the gap defines an angle measured from the first side of the protective panel to the first surface of the member, and the gap is configured to receive at least a portion of a protective panel of another modular unit of the ballistic barrier.

2. The ballistic barrier of claim 1, wherein the protective panel includes a material configured to withstand rifle rounds rated up to NIJ level IV 30-06 AP.

3. The ballistic barrier of claim 1, wherein the first surface along with the first side of the protective panel defines at least a portion of the gap, the gap defines an angle measured from the first surface to the first side, and the angle is between about 0° and about 90°.

4. The ballistic barrier of claim 3, wherein the angle is between about 30° and about 60°.

5. The ballistic barrier of claim 1, further comprising a foot assembly configured to provide support for the modular unit so as to prevent the modular unit from tipping over as a result of a force from a ballistic projectile impacting the modular unit.

6. The ballistic barrier of claim 5, wherein the foot assembly includes a base plate coupled to the protective panel such that the base plate extends out from the second side of the protective panel.

7. The ballistic barrier of claim 1, wherein the protective panel includes a view port, a gun port, a transparent portion, or any combination thereof.

8. The ballistic barrier of claim 1, wherein the modular unit is a first modular unit, the frame is a first frame, the protective panel is a first protective panel, the ballistic barrier including a second modular unit, and the second modular unit includes:

a second frame and a second protective panel coupled to the second frame, the second protective panel having a first side that faces the second frame and a second side that is opposite the first side of the second protective panel, the second side of the second protective panel including a ballistic resistant material configured to withstand a ballistic projectile fired toward the barrier, wherein a portion of the second protective panel is positioned within the gap such that a straight line passes through each of: 1) the first surface of the member, 2) the gap, 3) the portion of the second protective panel, and 4) the first side of the first protective panel.

9. The ballistic barrier of claim 1, wherein the modular unit is a first modular unit, the frame is a first frame, the protective panel is a first protective panel, the ballistic barrier including a second modular unit, and the second modular unit includes:

a second frame and a second protective panel coupled to the second frame, the second protective panel having a first side that faces the second frame and a second side that is opposite the first side of the second protective panel, the second side of the second protective panel including a ballistic resistant material configured to withstand a ballistic projectile fired toward the barrier, wherein the second protective panel abuts the first protective panel thereby defining a first point of contact between the first and second modular units, and the second protective panel simultaneously abuts the first surface of the member thereby defining a second point of contact between the first and second modular units.

10. The ballistic barrier of claim 1, wherein the frame includes a top plate and a bottom plate that each extend from the first side of the protective panel.

11. The ballistic barrier of claim 10, wherein at least one of the top plate and the bottom plate includes one or more openings, the one or more openings configured to receive a linkage member that operates to secure the modular unit to another modular unit of the ballistic barrier.

12. The ballistic barrier of claim 1, wherein the first side of the protective panel defines an outer perimeter, and an entirety of the member is positioned within the outer perimeter.

13. A method of assembling a ballistic barrier, comprising:

positioning a first modular unit on a surface such that a first side of a first protective panel of the first modular unit faces in a first direction and a second side of the first protective panel faces in a second direction that is opposite the first direction, the first side including a first planar portion, and the second side including a second planar portion that defines a plane;

selecting an angle, from a range of angles, at which to position a second modular unit of the ballistic barrier with respect to the first modular unit, wherein the angle is measured between a first line that lies entirely within the plane and a second side of a second protective panel of the second modular unit;

after the selecting step, positioning the second modular unit on the surface and adjacent to the first modular unit such that a portion of the second protective panel is disposed between a first surface of a member of the first modular unit that extends from the first planar portion of the first side of the first protective panel and the first planar portion of the first side of the first protective panel;

wherein the second positioning step can be performed at any angle within the range of angles, and an entirety of the member is positioned within an outer perimeter defined by the first side with respect to the first direction.

14. The method of claim 13, further comprising the step of securing the second modular unit relative to the first modular unit such that a first side of the second protective panel faces in the first direction and a second side of the second protective panel faces in the second direction, the second side of the first protective panel being parallel to the second side of the second protective panel.

15. The method of claim 13, further comprising the step of securing the second modular unit relative to the first modular unit such that the second protective panel is non-parallel to the first protective panel.

16. The method of claim 13, wherein the second positioning step includes the step of facing the first surface of the member toward the second side of the second protective panel.

17. The method of claim 13, further comprising the step of positioning a third modular unit on the first modular unit such that a first side of a first protective panel of the third modular unit faces in the first direction and a second side of the third protective panel faces the second direction.

18. The method of claim 13, wherein the second positioning step includes moving a portion of the second modular unit into a gap that is at least partially defined by: 1) the first surface of a member of the first modular unit, and 2) the first side of the first protective panel.

19. The method of claim 13, wherein the range of angles is between about 0° and about 90°.

20. The method of claim 13, wherein the range of angles is between about 30° and about 60°.

* * * * *